US010364985B2

(12) United States Patent
Geselle

(10) Patent No.: US 10,364,985 B2
(45) Date of Patent: Jul. 30, 2019

(54) BIO-FUEL FURNACE

(71) Applicant: Olen Creative Group, LLC., Spring Hill, TN (US)

(72) Inventor: James Byron Geselle, Spring Hill, TN (US)

(73) Assignee: Olen Creative Group, LLC., Spring Hill, TN (US)

( * ) Notice: Subject to any disclaimer, the term of this patent is extended or adjusted under 35 U.S.C. 154(b) by 402 days.

(21) Appl. No.: 15/376,524

(22) Filed: Dec. 12, 2016

(65) Prior Publication Data

US 2018/0163962 A1 Jun. 14, 2018

(51) Int. Cl.

| | |
|---|---|
| ***F23G 5/00*** | (2006.01) |
| ***F23G 5/08*** | (2006.01) |
| ***F23G 5/32*** | (2006.01) |
| ***F23G 5/44*** | (2006.01) |
| ***F23G 7/10*** | (2006.01) |
| ***F23J 15/02*** | (2006.01) |

(52) U.S. Cl.

CPC ..... *F23G 5/008* (2013.01); *F23G 5/08* (2013.01); *F23G 5/32* (2013.01); *F23G 5/442* (2013.01); *F23G 7/10* (2013.01); *F23J 15/027* (2013.01)

(58) Field of Classification Search

CPC ... F23G 5/008; F23G 7/10; F23G 5/32; F23G 5/08; F23G 5/442; F23J 15/027

See application file for complete search history.

(56) References Cited

U.S. PATENT DOCUMENTS

| | | | | |
|---|---|---|---|---|
| 4,060,041 | A | 11/1977 | Sowards | |
| 4,319,556 | A | 3/1982 | Schwartz et al. | |
| 4,466,359 | A | 8/1984 | Weber et al. | |
| 4,471,751 | A * | 9/1984 | Hottenroth | F24C 1/16 126/15 R |
| 4,619,209 | A | 10/1986 | Traeger et al. | |
| 5,000,100 | A | 3/1991 | Mendive et al. | |
| 5,054,405 | A * | 10/1991 | Walker | F23G 5/14 110/165 A |
| 5,060,584 | A | 10/1991 | Sowards et al. | |
| 5,311,828 | A | 5/1994 | Wu et al. | |
| 6,223,737 | B1 | 5/2001 | Buckner | |
| 7,235,217 | B2 * | 6/2007 | Nguyen | B01J 19/2485 165/173 |

(Continued)

*Primary Examiner* — David J Laux

(74) *Attorney, Agent, or Firm* — Crump Law P.C.

(57) ABSTRACT

A bio-fuel furnace for use in waste management, non-combustible particulate collection and useable energy production. The bio-fuel furnace includes a combustion unit, a particle separator, an airflow management system. The combustion unit includes a modular ceramic core of stacked cylindrical sections, which store thermal energy. The stacked core sections form an internal combustion chamber and an expansion chamber. The airflow management system regulates airflow through the combustion unit and the particle separator forcing super heated ambient air into the combustion unit and drawing exhaust air from the particle separator to precisely control both the combustion process and the storage of useable thermal energy. The airflow management system includes a series of preheat coils wrapped around the ceramic core, an inlet fan which forces ambient air through the coil into the combustion unit and an exhaust fan that draws exhaust air through the separator and from the combustion unit.

14 Claims, 7 Drawing Sheets

(56) References Cited

U.S. PATENT DOCUMENTS

| | | | | |
|---|---|---|---|---|
| 7,823,578 | B2 | 11/2010 | Ruppel et al. | |
| 2007/0137537 | A1 | 6/2007 | Drisdelle et al. | |
| 2008/0066731 | A1 | 3/2008 | Johnson | |
| 2015/0017594 | A1* | 1/2015 | Wilson | F23N 3/08 432/23 |
| 2015/0081086 | A1 | 3/2015 | Hallowell, Jr. et al. | |

* cited by examiner

BIO-FUEL FURNACE

This invention relates to furnaces for burning bio-fuels for waste management, non-combustible particulate collection and useable energy production.

BACKGROUND OF THE INVENTION

The term "bio-fuel" refers to renewable energy sources obtained from various living or recently living biological materials, but generally excludes fossil fuels, which are also organic materials that have been transformed through geological process. Although they have their origin in ancient biological matter ("biomass"), they are not considered bio-fuels by the generally accepted definition because they contain carbon that has been "out" of the carbon cycle for a very long time. Plant and animal by-products can all be used as bio-fuels. Wood, forest residue, sawdust, yard clippings, domestic refuse, agricultural waste, shelled corn, non-food energy crops, animal fats, and dried manure can all be used as solid bio-fuels.

The burning of solid bio-fuel to generate heat began with the discovery of fire. Cut and split wood logs have been burned in furnaces for centuries and wood remains the most recognized and readily used type of solid bio fuel for heat production. Firewood and wood pellet furnaces are well known and commonly used for domestic heating applications. Bio-fuel furnaces have been developed for HVAC application and electrical power generation with limited success. Bio-fuel furnaces have also been developed specifically to incinerate a variety of residential, commercial, industrial and municipal waste products. Generally, these furnaces simply burn waste products for solely disposal purposes.

Conventional bio-fuel furnaces are limited to the types of bio-fuels that can be burned. Different bio-fuels have different ignition temperatures. Bio-fuels also have different moisture contents which effect the combustion process of bio-fuel furnaces. Heretofore, conventional bio-fuel furnaces used for waste incineration and energy generation have difficulty burning solid bio-fuel with high moisture content, which is generally more than fifteen percent (15%) moisture content. Normally, burning "dry" bio-fuels produces flame temperatures ranging between 900-1600° F. When bio-fuels having a high moisture content, that is generally exceeding fifteen percent (15%), are burned in conventional furnaces, steam is produced, which quickly reduces the temperature of the flame below the combustion temperature of the bio-fuel thereby extinguishing the flame.

In addition, conventional bio-fuel furnaces are limited to the amount of non-combustible materials that can be mixed with the bio-fuel. Noncombustible contaminants in the bio fuel can include sand, small rocks and gravel, metal scraps, glass and other inorganic material. Generally, conventional bio-fuel furnaces are limited to no more than a three percent (3%) mix of non-combustible materials in the bio-fuel. Non-combustible materials not only reduce the efficient combustion of conventional bio-fuel furnaces but can also damage the fuel feed augers, burn trough and other components. In the combustion process, at temperatures below 1600° F., non-combustible materials combine chemically to the non-combusted fuel particles resulting in a "clinker," which is a lump of both non-combustible and un-combusted material. Clinkers block air-flow greatly reducing combustion efficiency and can eventually extinguish the flame.

SUMMARY OF THE INVENTION

The present invention provides a bio-fuel furnace for use in waste management, non-combustible particulate collection and useable energy production that can efficiently burn all types of bio-fuel in most fuel forms, including solid, semi-solid (slugs) and liquid bio-fuels in continuous operation. The bio-fuel furnace reduces the bio-fuel to elemental ash and non-combustible particulate, which is collected from the exhaust airflow in an integrated particle separator before being vented from the furnace. Unlike conventional bio-fuel incinerators and furnaces, which radiate thermal energy, the bio-fuel furnace of this invention is designed to store thermal energy generated in the combustion of bio-fuel within the ceramic body of the combustion core. A portion of the stored thermal energy is used to super heat ambient inlet air, which allows the furnace to completely and efficiently consume the bio-fuel within the combustion core. The efficient combustion of the furnace design allows the use of bio-fuel with high moisture content (above 25%) and non-combustible content.

The bio-fuel furnace of this invention is suitable for a variety of residential, commercial and municipal applications. In certain applications, the biomass furnace can be adapted as a stand alone biomass incinerator for commercial and municipal waste disposal and management. In other applications, the biomass furnace can be adapted to resource excess thermal energy in the combustion of biomass for electrical generation and HVAC applications. The bio-fuel furnace of this invention uses a modular design and standard piping, fittings, duct work, electrical wiring, connectors, valves and components, which can be readily repaired or replaced in the field without special tools or skill. The furnace is also scalable and can be sized to suit any particular application incinerating the desired volumes of bio-fuel and generating the desired BTUs of thermal energy from the combustion for other uses.

An exemplary embodiment of a bio-fuel furnace of this invention includes a support structure, a fuel feed meter, a combustion unit, a particle separator, an airflow circulation/preheat system and electronic control system. The combustion unit includes a modular ceramic core, which is wrapped in a thermal insulating blanket and enclosed by a thermal protective fabric covering. The ceramic core consists of stacked cylindrical sections molded from high performance ceramics, which store thermal energy. The stacked core sections form an internal combustion chamber and an expansion chamber situated directly above the combustion chamber. The Particle separator is a separate unit positioned adjacent the combustion unit. The particle separator separates and collects any non-combustible particulate and elemental ash within the exhaust air from the combustion unit before venting the exhaust air from the furnace. The airflow management system facilitates and regulates the airflow through the combustion unit and the particle separator forcing super heated ambient air into the combustion unit and drawing exhaust air from the particle separator to precisely control both the combustion process and the storage of useable thermal energy generated in the combustion process. The airflow management system includes a series of preheat coils wrapped around the ceramic core and the housing of the particle separator, an inlet fan which forces ambient air through the coil into the combustion unit and an exhaust fan that draws exhaust air from the separator and combustion unit.

Thermal energy stored in the ceramic core is conducted into preheat coils wrapped around the core. The inlet fan forces ambient air through the preheat coils and into the combustion chamber through angled inlet ports at the bottom of the ceramic core. Passing through the preheat coils, the ambient inlet air is heated above the ignition temperature of the particular bio-fuel. Forcing the super heated inlet air through the angled inlet ports at the bottom of the ceramic core section creates a rising vortex of swirling, turbulent super-heated inlet airflow within which the bio-fuel is burned. Bio-fuel is suspended and combusted within this combustion vortex. The airflow of this combustion vortex spirals upward with sufficient velocity and turbulent force to break apart the clumps of bio-fuel into finer and finer pieces until fully combusted upon entering the expansion chamber through a narrow throat from the combustion chamber. Thermal energy from the combustion of the bio-fuel within the combustion and expansion chambers is transferred and stored in the body of the ceramic core. The exhaust fan draws combustion exhaust into the particle separator where elemental ash and non-combustible particulate is separated from the exhaust gases and fall to the bottom of the separator before venting from the furnace.

Other advantages and features of the present invention will become apparent from the following description of an embodiment of the invention with reference to the accompanying drawings.

BRIEF DESCRIPTION OF THE DRAWINGS

The drawings illustrate an embodiment of the present invention, in which.

DESCRIPTION OF THE PREFERRED EMBODIMENT

Figure 1:
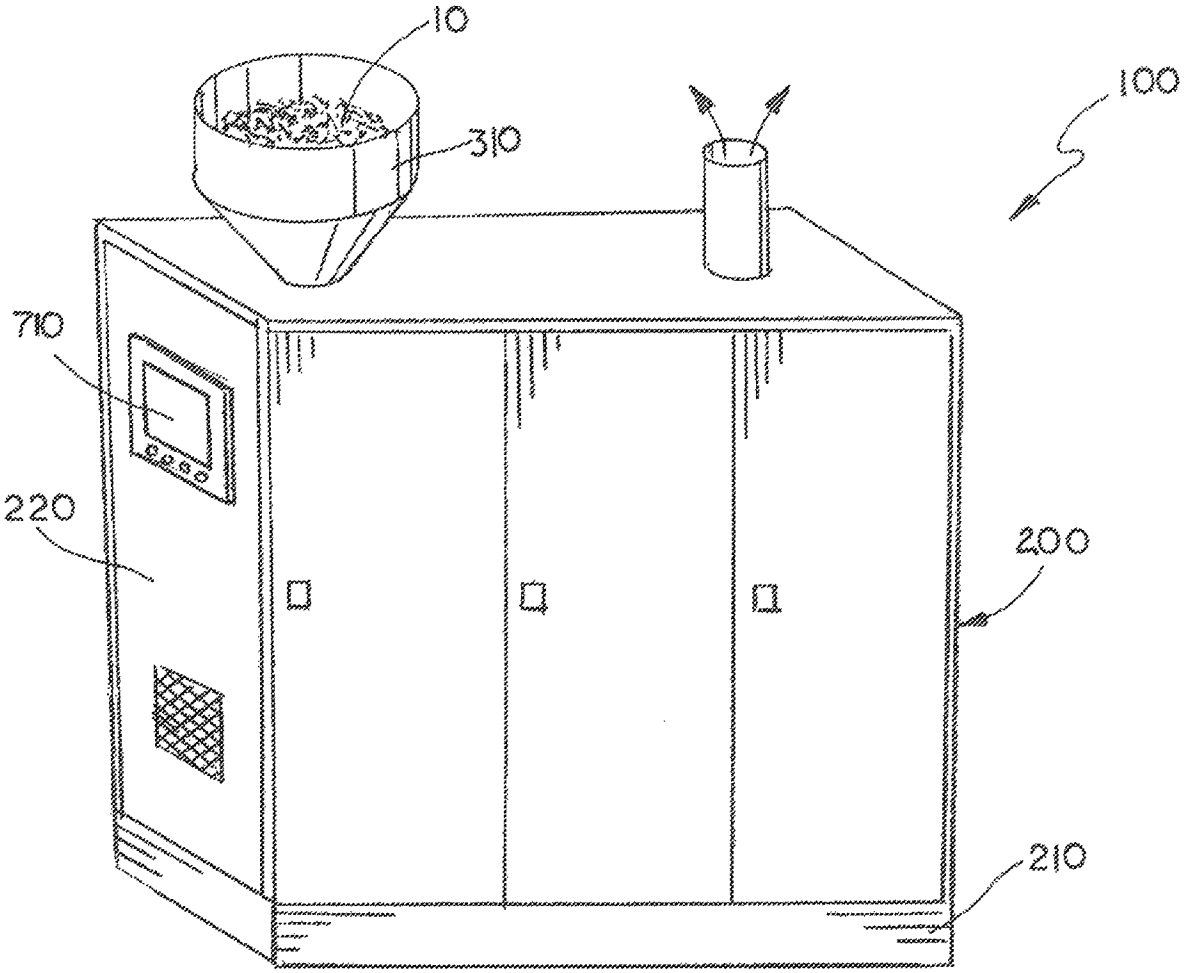
FIG. 1 is a perspective view of an exemplary embodiment of the bio-fuel furnace of this invention.

In the following detailed description of the preferred embodiments, reference is made to the accompanying drawings that form a part hereof, and in which is shown by way of illustration one or more specific examples of the invention and the manner that the invention may be practiced. The various exemplary embodiments of this invention are described in sufficient detail to enable those skilled in the art to practice the invention. To avoid detail not necessary to enable those skilled in the art to practice the invention, the description may omit certain information known to those skilled in the art. It will be apparent to those skilled in the art that various adaptions, modifications and variations can be made to the teachings of the present disclosure without departing from the scope of the invention. For instance, features illustrated or described as part of one embodiment can be used with another embodiment to yield a still further embodiment. Furthermore, it is to be understood by one of ordinary skill in the art that the present discussion is a description of exemplary embodiments only and is not intended as limiting the broader aspects of the invention.

The bio-fuel furnace of this invention is suitable for a variety of residential, commercial and municipal applications. The biomass furnace of this invention is designed to efficiently burn biomass for waste management and energy conversion applications. In certain applications, the biomass furnace can be adapted as a stand alone biomass incinerator for commercial and municipal waste disposal and management. In other applications, the biomass furnace can be adapted to resource excess thermal energy in the combustion of biomass for electrical generation and HVAC applications.

The bio-fuel furnace of this invention can be adapted to efficiently burn all types of bio-fuel in most fuel forms, including solid, semi-solid (slugs) and liquid bio-fuels. The bio-fuel furnace is designed for continuous operation and is scalable and can be sized to suit any particular application incinerating the desired volumes of bio-fuel and generating the desired BTUs of thermal energy from the combustion for other uses. The bio-fuel furnace reduces the bio-fuel to elemental ash and non-combustible particulate, which is collected from the exhaust airflow in an integrated particle separator before being vented from the furnace.

Unlike conventional bio-fuel incinerators and furnaces, which radiate thermal energy, the bio-fuel furnace of this invention is designed to store thermal energy generated in the combustion of bio-fuel within the ceramic body of the combustion core. A portion of the stored thermal energy is used to super heat ambient inlet air, which allows the furnace to completely and efficiently consume the bio-fuel within the combustion core. The efficient combustion of the furnace design allows the use of bio-fuel with high moisture content (above 25%) and non-combustible content.

Referring now to the drawings, FIGS. 1-6 illustrate an exemplary embodiment of the bio-fuel furnace of this invention, which is designated and identified as reference number 100. Bio-fuel furnace 100 is designed to burn solid bio-fuel in a shredded, granulated or pelletized form (the bio-fuel). Bio-fuel furnace 100 can efficiently burn bio-fuels with moisture content in excess of twenty-five percent (25%). The furnace of this invention will efficiently burn any combination or mixture of bio-fuel. By way of example, bio-fuel furnace 100 will burn bio-fuel consisting of shredded and pelletized paper with a very low moisture content, as well as, pelletized grass clippings having a higher moisture content, pelletized fatty oils can be burned alone or in combination with shredded tree branches, or shredded plastics can be burned with other shredded office waste products.

Furnace 100 includes several main assemblies and systems, including: a support structure 200, a fuel feed metering assembly 300, combustion unit 400, an airflow circulation/preheat system 500, particulate precipitator 600, and electronic control system 700. As shown, furnace 100 is intended for use in small commercial applications to incinerate solid bio-mass and collect inert, non-combustible particles and for generating up to 500,000 BTUs of thermal energy. The bio-fuel furnace uses a modular design and standard piping, fittings, duct work, electrical wiring, connectors, valves and components which can be readily repaired or replaced in the field without special tools or skill.

Support structure 200 includes a platform base 210 and an outer housing 220, which carry, support and enclose the various assemblies and systems of furnace 100. Platform base 210 has a metal beam frame and platform, which are designed to allow furnace 100 to be lifted and transported by fork truck or pallet lift. Housing 220 also has a metal frame affixed to platform base 210 and removable side and top panels, which allow access to the various components and assemblies. In certain embodiments, support structure 200 can be adapted and rigged to be dropped from aircraft into remote locations for military and emergency relief applications.

Fuel meter Assembly 300 is adapted to be connected to a bio-fuel supply system (not shown) external to furnace 100 in most applications. Fuel meter assembly 300 includes a fuel bin 310 and a fuel meter 320. Fuel bin 310 is mounted atop housing 220 and fuel meter 320 is suspended within housing adjacent combustion unit 400. A vertical feed chute 390 connects fuel bin 310 to feed meter 320. Bio-fuel 10 is gravity fed into fuel meter 320 from fuel bin 310. Feed meter 320 uses a self-cleaning "Ferris wheel" type mechanism for batch feeding combustion unit 400. The Ferris wheel type mechanism also functions as an air lock for combustion unit 400 sealing its internal combustion chamber. Feed meter 320 includes a rotating feed wheel 322 enclosed within a meter housing 324 and driven by an electric motor (not shown). Feed wheel 322 rotates about a horizontal axis and has a plurality of radial scoop sections 323 that receive a set volume of bio-fuel. As feed wheel 322 rotates, bio-fuel falls vertically through a top opening 325 in meter housing 324 from fuel bin 310 collecting in the uppermost scoop section 323. Simultaneously, bio-fuel collected in the lowermost scoop section 323 of feed wheel 322 falls vertically through a bottom opening (not shown) in meter housing 324 into combustion unit 400. The drive motor is controlled as part of electrical control system 700 to incrementally advance the rotation of feed wheel 322. Incrementally advancing the rotation of feed wheel 322 allows a measured batch of bio-fuel to be deposited into combustion unit 400.

Combustion unit 400 includes modular ceramic core 410, which is wrapped in a thermal insulating blanket 480 and enclosed by a thermal protective fabric covering 490. The ceramic core consists of four stacked cylindrical core sections 420, 430, 440 and 450. Core 410 also includes a ceramic feed chute 460. The core sections and feed chute are constructed from high performance ceramic materials. The ceramic materials are selected for thermal properties, particularly the ceramic's ability to absorb and hold thermal energy generated in the combustion process. The ceramic material of core 410 allows thermal energy generated in the combustion of the bio-fuel to be internally absorbed and stored within the body of the core. Ideally, the ceramic materials can maintain stored BTUs at levels above the ignition temperatures of the bio-fuels for several hours or even a few days. The desired ceramic materials do not structurally degrade when exposed to the high temperatures of the combustion process and have very high wear resistance. In addition, the desired ceramic materials can be easily molded or formed with very smooth or polished interior surfaces. Such ceramic materials include the sol-gel materials commercially available from Reno Refractories and cast or molded using sol-gel casting methods, available by such companies as Megneco/Metral, inc. of Addison Ill. This type of ceramic material uses colloidal silica as a source of nano-scale spherical particles and contains no chemically bonded water. The sol-gel ceramic combines two components, a dry powder and a liquid binder that are mixed and poured or pumped into a mold.

Figure 3:
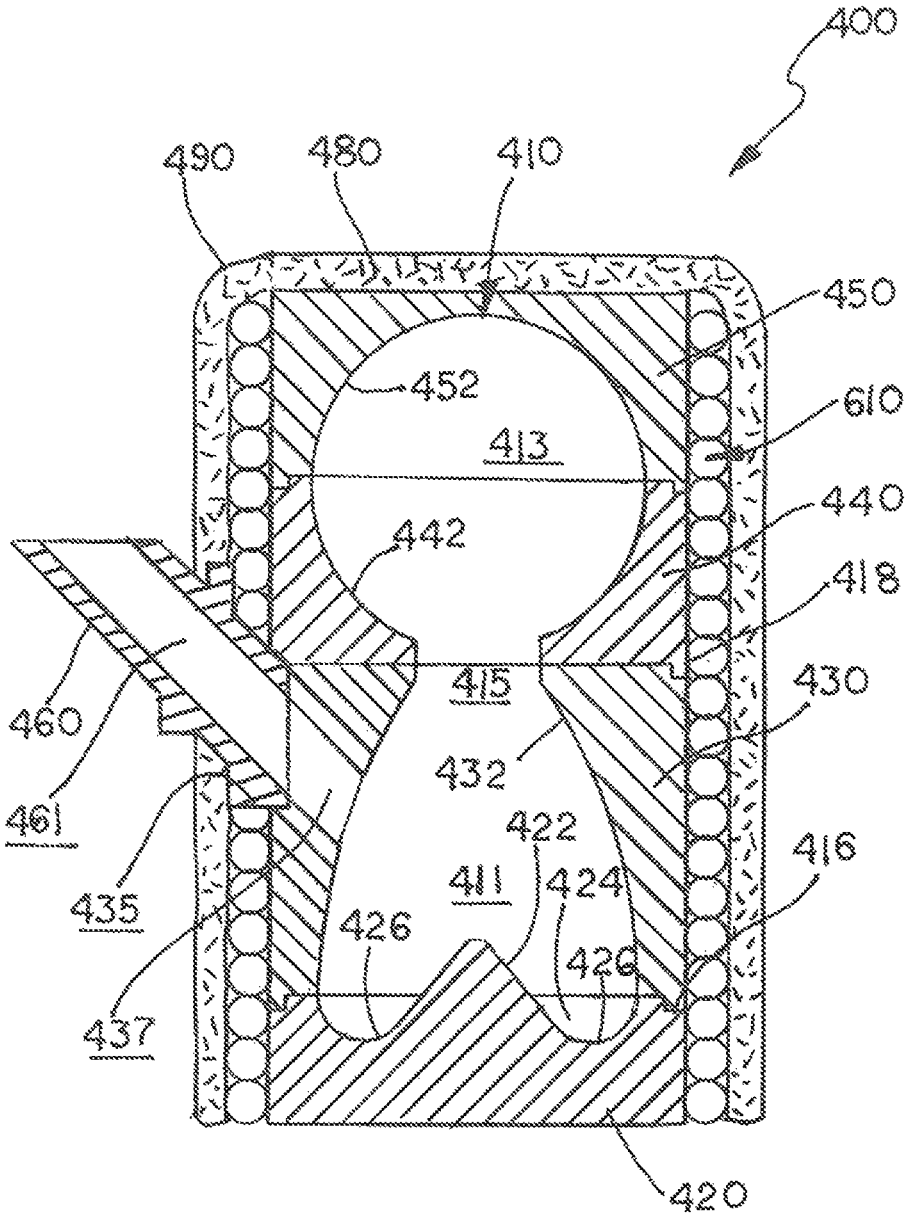
FIG. 3 is a side sectional view of the combustion unit of the bio-fuel furnace of FIG. 1.
Figure 4:
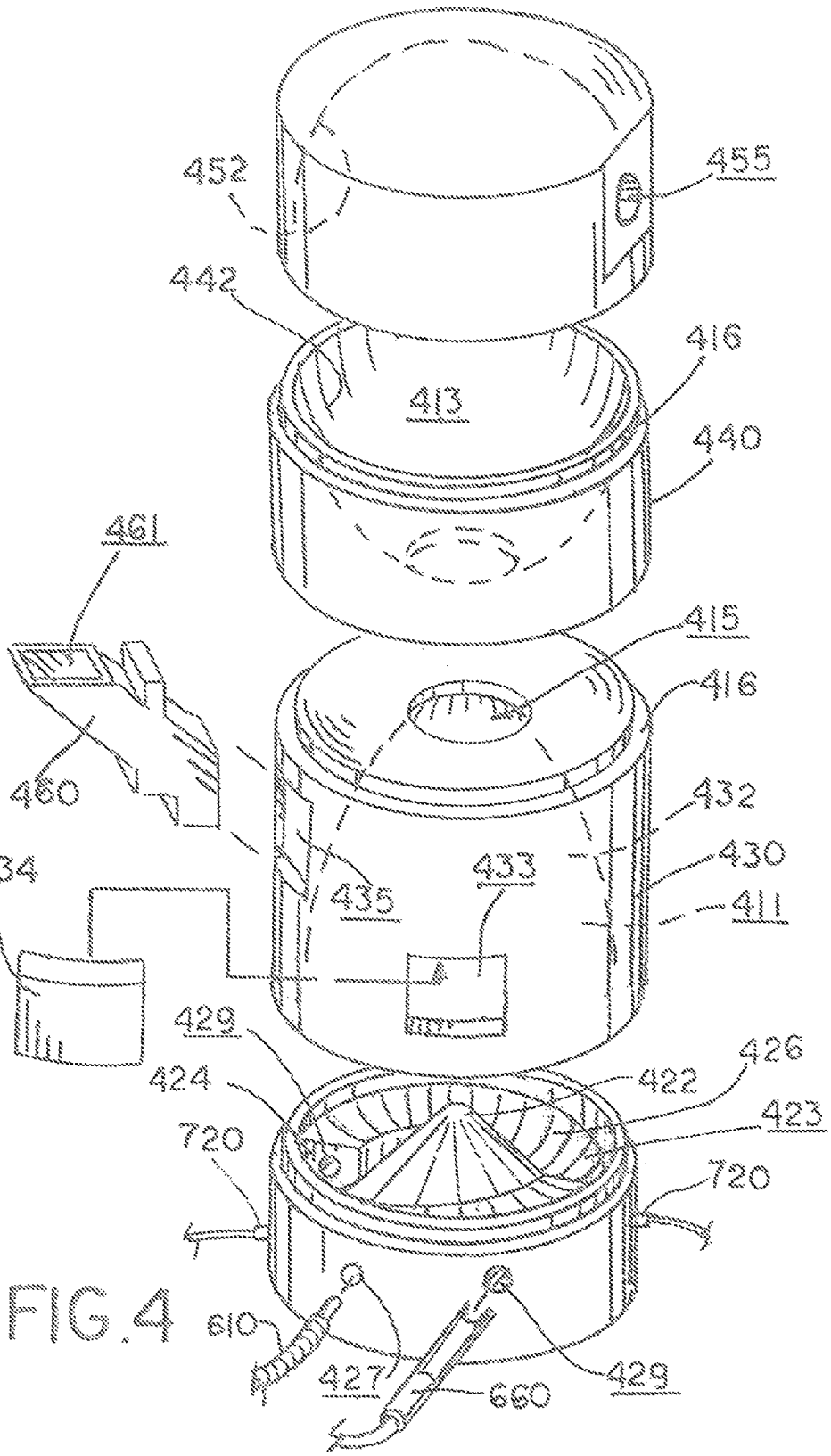
FIG. 4 is an exploded view of the ceramic core of the bio-fuel furnace of FIG. 1.
Figure 5:
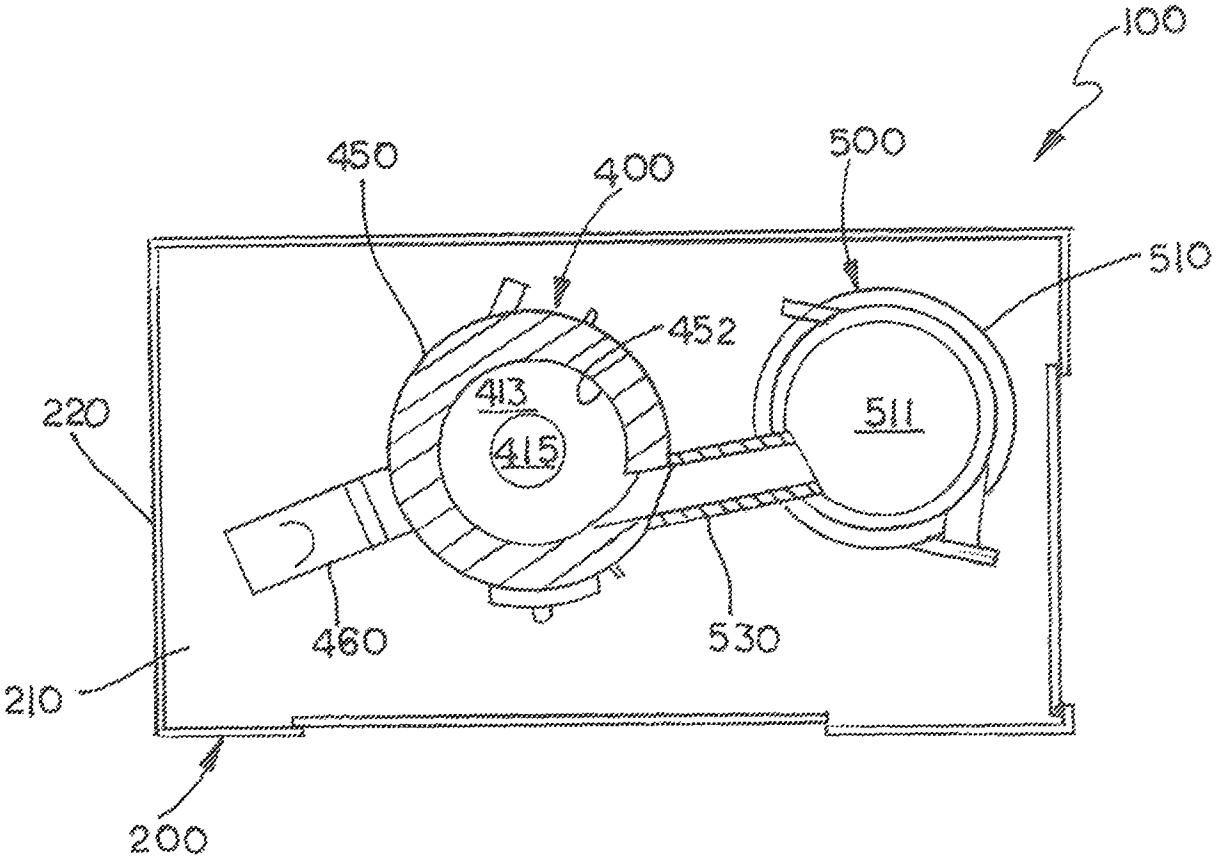
FIG. 5 is a simplified top sectional view of the bio-fuel furnace of FIG. 1.

As best shown in FIGS. 3 and 4, core sections 420, 430, 440 and 450 are vertically stacked atop one another and mechanically interlocked and structurally secured in a tongue and groove type connection. Each core section is formed to have a peripheral upper shoulder 416 and a mating annular lower flange 418. When stacked the annular flange on one core section seats within the shoulder of the core section below, holding the sections together. The core sections are stacked together to form an internal combustion chamber 411 and an expansion chamber 413 situated directly above the combustion chamber. Combustion chamber 411 is defined by the contour of the top surface of core section 420 and a domed inner surface 432 of core section 430. Expansion chamber 413 is defined by inner surfaces 442 and 452 of core sections 440 and 450. Aligned central openings in the top of core section 430 and the bottom of core section 440 form a narrowed passage or throat 415 between combustion chamber 411 and expansion chamber 413.

The top of core section 420 has a raised central cone 422 and a pair of semi-circular air inlet channels 423 recessed concentrically around the central cone. Each inlet channel 423 is defined by a vertical channel end wall 424 and an arcuate channel floor 426 formed in the top of core section 420 that extends half way around central cone 422. Channel floors 426 are formed to slope upward from the bottom of one channel end wall 424 and terminate at the top of the channel end wall forming the opposite inclined channel. Inner surface 432 of core section 430 is a steeply domed surface 432. Inner surfaces 442 and 452 are generally semi-spherical thereby giving expansion chamber 413 a general spherical configuration. Core section 420 has a pair of inlet air ports 427 and a pair of compressed air openings 429. Inlet air ports 427 extend through the side wall of core section 420 at an angle to both the longitudinal and lateral axis of core 410. Inlet air ports 427 emerge from the sidewall of core section 420 above the lowest point of channels 423. Compressed air openings 429 extend through the sidewall of core section 420 tangentially to the center of channels 423 and perpendicular to end walls 424 emerging at the base of the end wall just above channel floor 426. Core section 450 has a side exhaust opening 455 that extends laterally through the side wall of the core section.

Core section 430 has a removable access plug 434, which is seated in a side opening 433 to provide limited access to the combustion chamber 411. Core section 430 also has a rectangular side opening or chute seat 435 for receiving feed chute 460 and a rectangular feed passage 437. Feed passage 437 extends at an angle through the side wall of core section 430 from the side opening into the combustion chamber 411.

Feed chute 460 is molded or formed generally as a rectangular tube that extends at an angle from core 410. Feed chute 460 has a rectangular feed passage 461 that is dimensioned to match that of feed passage 437 of core section 430. Chute 460 is fitted within a rectangular side opening 435 in core section 430 so that the feed passage 461 of feed chute 460 aligns axially with the feed passage 437 of core section 430.

As shown in FIG. 3, core 410 is enclosed on its sides and top by a removable insulating thermal blanket 480 and fabric outer covering 490. Thermal blanket 480 is a thick insulating mat of suitable thermal insulating materials, which wraps tightly around and covers core 410. The bottom of core 410 may also be covered with a suitable insulating material or seated atop an insulating plate as desired. Outer covering 490 is constructed of a suitable woven fabric to provide durability and thermal protection. Outer covering 490 is configured to enclose core 410 and have various openings, flaps and closures to provide access to core 410.

Particle separator 500 is a separate unit positioned adjacent combustion unit 400. Particle separator 500 separates and collects any non-combustible particulate and elemental ash within the exhaust air from the combustion unit before venting the exhaust air from furnace 100. Particle separator 500 includes a cylindrical outer housing 510 having an open interior 511. Separator housing 510 generally has a ceramic upper portion and a metal lower portion. The upper portion of separator housing 510 is ceramic to accommodate the high temperatures of the exhaust air venting from combustion unit 400. The construction materials of separator housing 510 are also selected to transfer thermal energy therethrough. As with core 410, separator housing 510 is wrapped in a thermal insulating blanket 580 and fabric covering 590. Support legs 512 suspend separator housing 510 above support platform 210.

A cross-over conduit 530 connects exhaust opening 455 of core 410 to an exhaust inlet opening 515 of separator housing 510. Exhaust inlet opening 515 is formed in the housing sidewall near the top of separator housing 510. Separator housing 510 has an exhaust opening 517 formed in its top wall and a particle collection opening 519 formed in its bottom wall. Exhaust opening 517 is connected in open communication with airflow management system 600. A removable tray 520 is seated within a mounting bracket 522 affixed to the bottom wall of separator housing 510. Tray 520 collects non-combustible particles 30 separated from the exhaust airflow from combustion unit 400 falling through opening 519.

Figure 2:
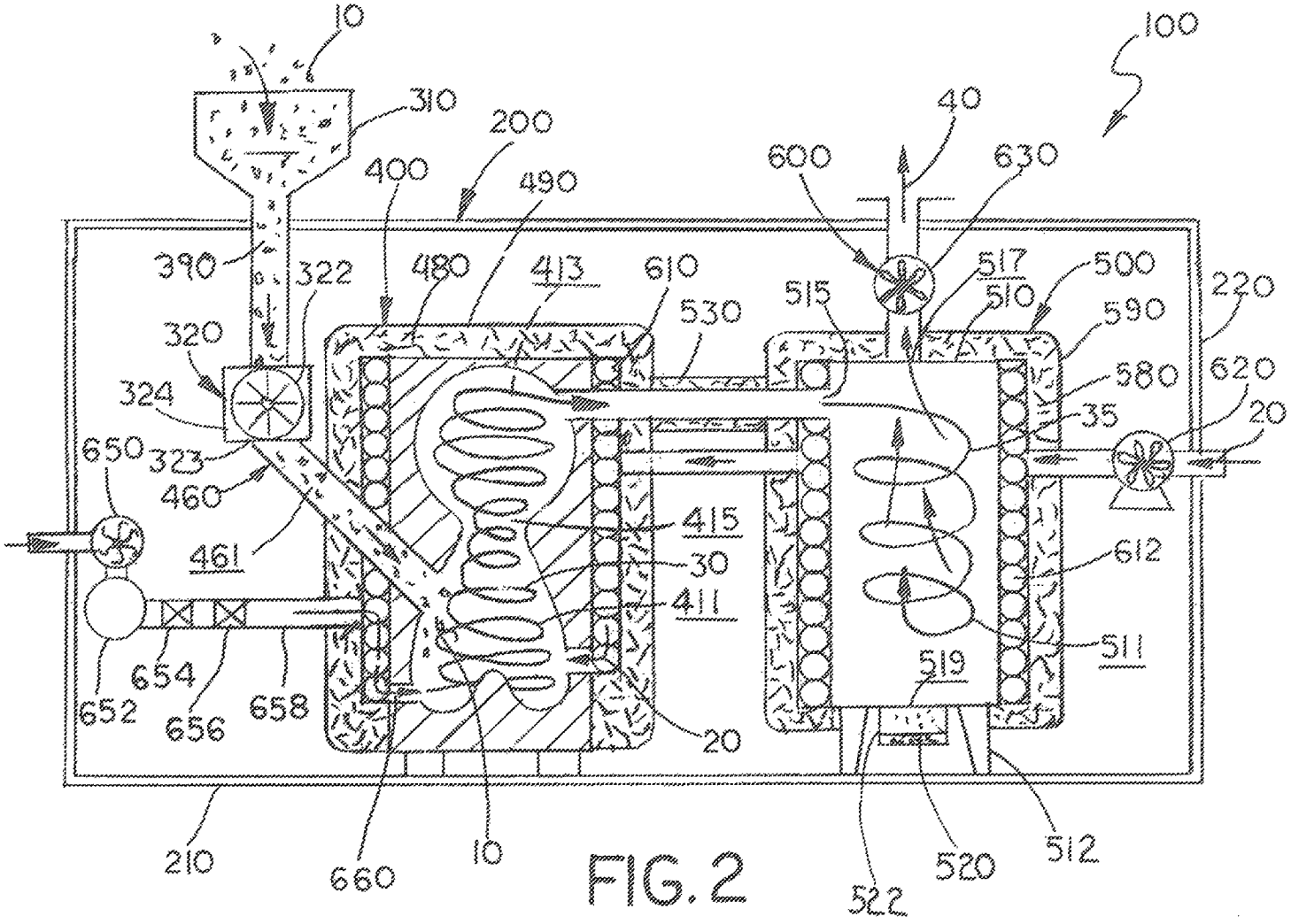
FIG. 2 is a simplified diagram of the bio-fuel furnace of FIG. 1 illustrating the fuel feed and airflow through the combustion unit and particle separator.

As shown in FIG. 2, airflow management system 600 facilitates and regulates the airflow through the combustion unit 400 and particle separator 500 forcing super heated inlet air into the combustion unit 400 and drawing airflow from particle separator 500 to precisely control both the combustion process and the storage of useable thermal energy generated in the combustion process. Airflow management system 600 includes a series of preheat coils 610 and 612, an inlet fan 620 and an exhaust fan 630, which are used to facilitate and control the combustion processes for furnace 100. Inlet and exhaust fans 620 and 630 are various high speed, high output blowers of any conventional design, which facilitate airflow into and from combustion unit 400 and particle separator 500. It should be noted that while both fans are high speed, high output blowers, exhaust fan 630 is selected so that it generates a greater airflow than inlet fan 620. Exhaust fan 630 draws a greater airflow from combustion unit 400 and particle separator 500 than the inlet airflow forced into the combustion chamber by inlet fan 620.

Preheat coils 610 and 612 are wrapped helically around core 410 and particle separator housing 510 and covered by insulating blankets 480 and 580. Typically, preheat coils 610 and 612 are corrugated metal tubing, which are designed to transfer thermal energy stored in core 410 and separator housing 510 from the combustion of bio-fuel into the inlet airflow before entering the combustion chamber 411. Preheat coils 610 and 612 are connected in open communication with each other and may consist as a single continuous length of coil. Preheat coil 610 is connected in open airflow communication to air inlet openings 427 of core section 430 near the bottom of combustion chamber 411.

Inlet fan 620 is connected in open airflow communication with preheat coil 612 and inlet air port 427. Exhaust fan 630 is connected in open airflow communication to exhaust opening 517 of separator housing 510. Inlet fan 620 draws ambient air through preheat coils 610 and 612 and into combustion chamber 411 through inlet air ports 427, while exhaust fan 630 draws exhaust airflow from separator interior 511 and expansion chamber 413.

Airflow management system 600 also includes air compressor 650 and inlet air nozzle 660, which are used to selectively purge bio-fuel from the combustion unit, as a maintenance cleaning or emergency shut-down function of combustion unit 400. Compressor 650 includes a compressor tank 652 and a pressure relief valve 654 and a control valve 656. Compressor 650 is connected to air lines 658 and a pair of blast nozzles 660 seated within compressed air openings 429 of core section 420. Blast nozzle 660 has an arcuate orifice 661 that extends into channel 423 at the bottom of end wall 424.

Figure 6:
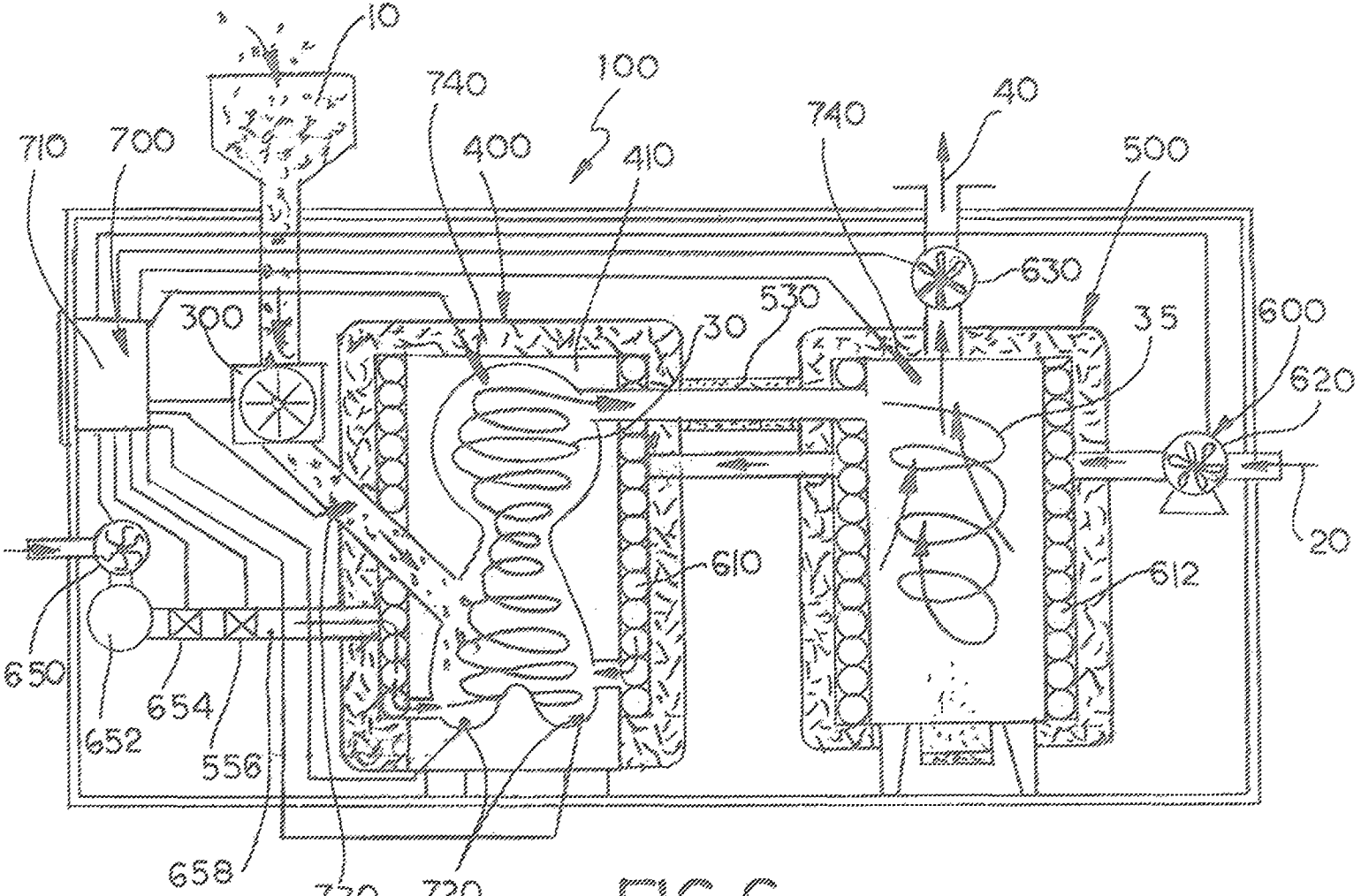
FIG. 6 is a simplified diagram of the bio-fuel furnace of FIG. 1 illustrating the electronic control system.

FIG. 6 illustrates the electronic control system 700 that controls the operation of furnace 100 and allows a user to set, monitor and control all operational functions and parameters of the furnace. Control System 700 includes an electronic PCL controller 710, a pair of ignitors 720, a vacuum pressure sensor 730 and multiple temperature sensors 740. Control systems 700 has a variety of built in safety features that ensure the safe operation of furnace 100.

Control system 700 uses a variety of electrical components and electronic circuitry commonly found in electrical control systems. Such electrical components and electronic circuitry are well known in the art and therefore not specifically described herein. Ideally, control system 700 is intended to be a direct current (DC) electrical system using DC control circuitry, motors, drivers, relays, switches and electrical components and circuitry for the various functions and operations of the system. However, in alternative embodiments, the control system may use or incorporate alternating current (AC) circuitry and components within the teachings of this invention.

As shown in FIG. 6, controller 710 is wired to the various motors, valves, switches and sensors of feed meter assembly 300, combustion unit 400, particle separator 500 and airflow management system 600. Controller 710 is of conventional design and operation, and includes a central processing unit, user interface, multiple I/O connections and memory for logic programming and operational data storage. Controller 710 is mounted to one of the side panels of housing 220. Controller 710 is electrically wired to the feed meter motor to control the metering bio-fuel 10 into combustion unit 400. Controller 710 is electrically wired to inlet fan 620 and exhaust fan 630 to control airflow through combustion unit 400 and particle separator 500. Controller 710 is also electrically wired to compressor 650, relief valve 654 and control valve 656 to control the fuel purge function of furnace 100.

Ignitors 720 are used to initiate the combustion process of bio-fuel within combustion chamber 411 on startup. Ignitors 720 are seated at the bottom of channels 223 and wired to controller 710. Ignitors 720 are of conventional design and typically consist of an exposed resistance wire that heats when electrical current is passed through it. Controller 710 actuates ignitors 720 to light a small quantity of deposed bio-fuel a blaze within combustion chamber 411.

Vacuum pressure sensor 730 is located within feed chute 460 and wired to controller 710. Vacuum sensor 730 measures the air pressure within feed passage 461. Multiple temperature sensors 740 are positioned at various locations in combustion unit 400 and particle separator 500. Temperature sensors 740 are wired to controller 710 to measure the temperatures at each sensor location. Certain temperature sensors 740 track the air temperatures of combustion vortex 35 within the combustion chamber 411 and expansion chamber 413. Other temperature sensors 740 track the air temperatures of exhaust airflows exiting combustion unit 400 and particle separator 500. Still other temperature sensors 740 are used to track the temperatures of the core 410, and preheat coils 610 and 612, as well as, surface temperatures of the combustion unit 400 and particle separator 500.

Controller 710 regulates the operation of furnace 10 monitoring various parameters and controlling the various functions and settings. Controller 710 regulates feed meter 300 to meter the amount of bio-fuel deposited into combustion unit 300 and coordinates the operation of inlet fan 620 and exhaust fan 630 to regulate the air flow through furnace 100. Controller 710 can be user programmed to operate based on various user defined parameters based on the composition of the bio-fuel used as a bio-fuel within the combustion unit, rate of fuel consumption, thermal energy (BTU) output generated and thermal energy (BTU) stored. Controller 710 is also used to switch furnace 100 between different operational modes, namely, a start up (initial firing) mode, a steady state operation mode, a fuel purge mode and a shutdown mode. Controller 710 monitors electrical input signals from the various temperature and air flow sensors at various locations within combustion unit 400, particle separator 500 and airflow management system 600 to precisely control and balance the metering of bio-fuel and airflow through furnace 100 maximizing combustion efficiency and regulating thermal energy stored and available for other uses.

In the startup mode, furnace 100 is fired to bring the temperature of ceramic core 410 to a set threshold temperature. On start up controller 710 signals ignitors 720 to fire a small quantity of bio-fuel deposited at the bottom of combustion chamber 411 and activates inlet fan 620 and exhaust fan 630 to begin circulating ambient air into the combustion chamber. Controller 710 activates feed meter 310 to deposit additional bio-fuel 10 into combustion chamber 411 to fuel the combustion. As the temperature of ceramic core 410 increases, controller 710 activates inlet fan 620 and exhaust fan 630 to increase or decrease the airflow through preheat coils 610 and 612, combustion unit 400 and particle separator 500. Once ceramic core 410 reaches a defined threshold temperature, furnace 100 operates at steady state.

Furnace 100 is designed for continuous operation in the steady state mode. Once core 410 reaches its threshold temperature, controller 710 switches into the steady state mode to maintain user selected operational parameters for bio-fuel consumption and BTU output and storage within core 410. During its steady state operation, controller 710 regulates the airflow through combustion unit 400 and particle separator 500, as well as the metering of bio-fuel into the combustion unit to maintain and balance the combustion process for the desired fuel consumption and/or thermal energy generation for any given application.

During operation in the steady state mode, inlet fan 620 and exhaust fan 630 move airflow through combustion unit 400 and particle separator 500. Ambient inlet air 20 is super heated above the particular combustion temperature of the bio-fuel before entering combustion chamber 411. Thermal energy generated from the combustion of bio-fuel 10 within combustion chamber 411 and expansion chamber 413 is stored within the body of ceramic core 410. Part of the thermal energy stored in core 410 is conducted into preheat coil 610, which super heats ambient inlet air 20 before entering combustion chamber 411. In addition, a portion of the remaining thermal energy of the exhaust air 40 entering particle separator 500 is transferred through separator housing 510 into preheat coil 612. Passing through preheat coils 610 and 612, ambient inlet air 20 is heated above the particular combustion temperature of the bio-fuel 20. Inlet fan 620 forces the super heated ambient airflow through angled inlet port 427 at the bottom of core section 220 venting ambient air into core 410 to create a rising helical airflow around cone 422 within combustion chamber 411. The directionally vented and super heated inlet air 20 creates within combustion chamber 411 a rising combustion vortex 30, i.e, a cyclone of swirling super-heated inlet air within which bio-fuel 10 is burned. As shown, bio fuel 10 falls directly into combustion vortex 30 where it is ignited and consumed. Inlet fan 620 provides inlet air of sufficient volume and velocity to suspend bio-fuel 10 within combustion airflow vortex 30. The combustion vortex 30 spirals upward through combustion throat 415 with sufficient velocity and turbulent force to break apart the clumps of bio-fuel into finer and finer pieces until fully combusted upon entering the expansion chamber 413. The velocity and turbulent swirling of combustion vortex 30 generally prevents bio-fuel 10 from settling in recessed channels 423 at the bottom of core section 210. The thermal energy released from the combustion of bio-fuel 10 along with the resultant exhaust gases and by-products expands and rises within combustion vortex 30. Temperatures at the center of combustion vortex 30 can reach 4000° F.

Controller 710 regulates the airflows from inlet fan 620 and exhaust fan 630 to maintain a slight negative pressure within combustion chamber 411, expansion chamber 413 and separator interior 511. Feed meter 310 provides an airlock to combustion unit 400 and inlet and exhaust fans 620 and 630 regulate the only airflow into and out of furnace 100. Exhaust fan 630 pulls a greater airflow from particle separator 500 through combustion unit 400 than inlet fan 620 introduces into the combustion unit. Consequently, exhaust fan 630 creates a slight negative pressure within separator interior 511, and also within expansion chamber 413 and combustion chamber 411. Pressure sensor 730 measures the internal air pressure within feed passage 461. Controller 710 monitors the signals from pressure sensor 730 and regulates inlet and exhaust fans 620 to maintain the desired negative pressure parameters within combustion chamber 411. If controller 710 detects a positive pressure reading or a reading outside the set parameters from vacuum sensor 730, controller 710 triggers an operational shut down of furnace 100.

The negative pressure created by exhaust fan 630 assists in pulling combustion vortex 30 upward through throat 415 into upper expansion chamber 413. The velocity and turbulence of combustion vortex 30 increase as it passes through the narrowed opening of throat 415, which breaks up any particles of bio-fuel ensuring complete combustion of bio-fuel 10. Entering expansion chamber 413, combustion vortex 30 expands and slows slightly. Combustion vortex 30 continues to swirl within expansion chamber 413 until drawn through crossover conduit 530 into particle separator 500 by exhaust fan 630.

Controller 710 may also be selectively programmed to activate air compressor 650 and control valve 656 to intermittently inject a blast of compressed air into combustion chamber 411. This controlled blast of compressed air creates a pressure pulse within combustion vortex 30 that assists in breaking apart any clumps of bio-fuel suspended in the vortex. The controlled blast of compressed air from compressor 650 functions similar to that of an agitator in a conventional washing machine breaking clumps of solid bio-fuel into fine particulate which is quickly and completely consumed in combustion vortex 30. Controller 710 can be user programmed to vary the interval and duration of the compressed air pulses based upon the particular type, composition and character of the bio-fuel being burned.

Exhaust fan 630 draws combustion air from combustion unit 400 into particle separator 500 near the top of separator housing 510. The tangential orientation of crossover conduit 530 between core 410 and separator housing 510 ensure that exhaust airflow 50 enters separator interior 511 at an angle creating a descending expansion vortex 35 of exhaust airflow within separator housing 510. Entering separator interior 511, the velocity of the swirling expansion vortex 35 allows elemental ash and non-combustible particulate to separate from the exhaust airflow and fall to the bottom of separator housing 510. In addition, remaining thermal energy within expansion vortex 35 transfers through separator housing into preheat coil 612 as the exhaust vortex slows and descends. Exhaust fan 630 draws a nearly particulate-free exhaust air 40 from separator interior 511 and vents it from furnace 100 through exhaust port 517. Elemental ash and non-combustible particulate 70 is collected in tray 520 for removal and recycling.

The purge mode of furnace 100 provides a cleansing function for combustion unit 400. The purge mode is used periodically to evacuate any bio-fuel and non-combustible particulate that may collect within ceramic core 410. In the purge mode, controller 710 activates compressor 650 to release a short blast of compressed air "purge blast" into combustion chamber 411 through nozzle 660. The purge blast dislodges any bio-fuel or non-combustible particulate that may fall through combustion vortex 30 and collect within channels 223. The purge blast has sufficient volume and velocity to purge and blow any settled bio-fuel and non-combustible particulate upward into combustion vortex 30 of combustion chamber 411.

In the shutdown mode, controller 710 deactivates feed meter 400, inlet fan 620 and exhaust fan 630 to eliminate both the fuel and oxygen sources thereby terminating the combustion process. Controller 710 can also activate compressor 650 to release a series of "purge blasts" into combustion chamber 411 through nozzle 660 to accelerate the shutdown process in the case of a critical condition, i.e., an emergency shutdown. During an emergency shutdown, the purge blasts from compressor 650 evacuate all bio-fuel and combusting gases from combustion unit 400 into the particle separator, immediately terminating the combustion process.

The furnace of this invention is designed to incorporate a variety of different heat exchangers for use in various heat distribution and energy generation applications. The furnace is designed so that a heat exchanger can be mounted directly atop its ceramic core and separator housing for directly conducting thermal energy into the exchangers through the ceramic core and separator housing.

Figure 7:
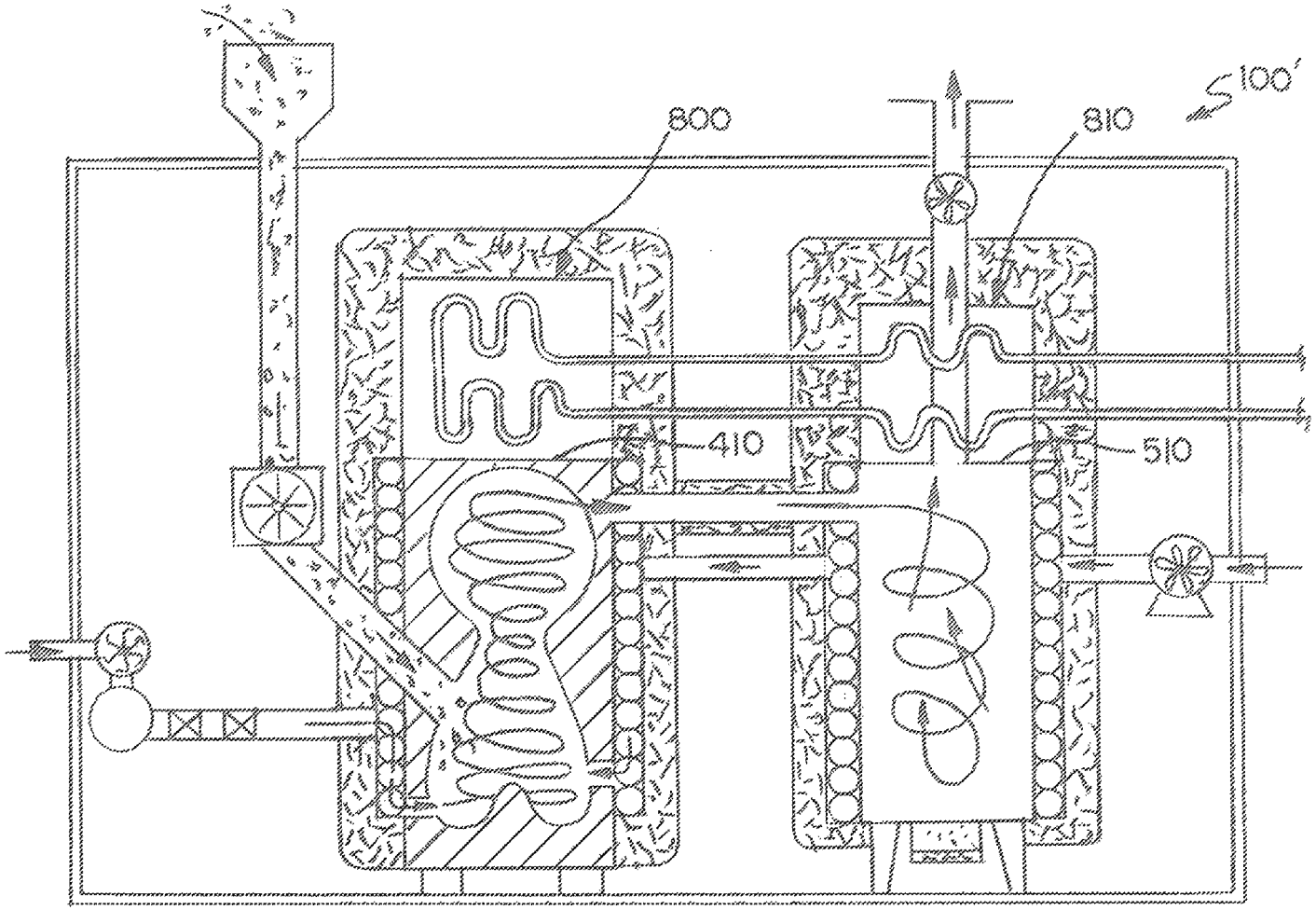
FIG. 7 is a simplified diagram of a second exemplary embodiment of the bio-fuel furnace of this invention incorporating a pair of module heat exchangers.

For example, FIG. 7 shows an embodiment of the bio-fuel furnace of this invention 100 designated as reference number 100'. Furnace 100' is identical to furnace 100 in function and construction, but incorporates a pair of heat exchangers 800 and 810 seated atop ceramic core 410' and separator housing 510'. Heat exchangers 800 and 810 are used to convert excess thermal energy stored in ceramic core 410' and separator housing 510' for other uses. Heat exchanger technology is well developed in the art and can be readily adapted or incorporated into the design of the furnaces of this invention. The functional design and configuration of heat exchangers 800 and 810 may take any desired form as desired for any particular purpose or HVAC application. As shown by way of example, heat exchangers 800 and 810 are shown as conventional bi-directional force air or hydronic units of the type used for HVAC applications. Heat exchangers 800 and 810 are modular components that seat directly atop ceramic core 410' and separator housing 510'. Thermal energy is conducted directly into heat exchangers 800 and 810 from surface contact with ceramic core 410' and separator housing 510', which is then transferred into a fluid medium circulated through the heat exchangers and distributed for use across the external HVAC system.

One skilled in the art will note several advantages of the present invention. The design of the bio-fuel furnace facilitates an efficient combustion of bio-fuel. The furnace's efficiency and ability to burn and incinerate bio-fuel is partly the result of super heating the inlet air and creating the combustion vortex within the combustion chamber in which the bio-fuel is burned. The combustion unit transfers a portion of the thermal energy generated by the combustion of the bio-fuel within the ceramic core into the preheat coils to preheat the ambient inlet air above the ignition point of the particular bio-fuel. The super heated inlet airflow is also directional venting into the combustion chamber through angled inlet ports, which create the combustion vortex. The bio-fuel metered into the combustion unit is suspended within the combustion vortex and thoroughly consumed as it rises into the expansion chamber. The bio-fuel furnace produces very low exhaust emissions reducing the bio-fuel to elemental ash and non-combustible particulate. The furnace also separates and collects non-combustible particulate from the combustion exhaust for re-purposing before being vented from the furnace. Because it burns bio-fuel so efficiently and stores the thermal energy within its ceramic core, the bio-fuel furnaces can burn bio-fuel with high non-combustible and moisture content.

The bio-fuel furnace also captures and stores the thermal energy generated in the combustion of the bio-fuel. The ceramic core of the bio-fuel furnace absorbs and stores thermal energy generated from the combustion insulated by the protective blanket and covering. A portion of the stored thermal energy is used to super heat the inlet airflow into the combustion chamber. The remaining stored energy in the ceramic core is readily available for transfer to heat exchangers and use by other systems, such as thermal electric generators. Thermal energy remaining in the exhaust airflow entering the particle separator is transferred through the separator housing into the preheat coils to assist in the heating of the ambient inlet airflow. As a result, the exhaust vented from the bio-fuel furnace is at such a temperature that is does not present a damage or require additional processing or cooling before reintroduction into the environment.

The bio-fuel furnace of this invention uses a modular design and standard component parts, such as, pipes, duct work, fittings, connectors, fans/blowers, motors, switches, sensors and wiring, which allows convenient repair, replacement and modification. Nearly all of the components, modules and assemblies can be repaired or replaced by users with basic tools and without specialized knowledge or skill. The electrical fans, motors, and control electronics can be powered by a low voltage DC electrical source, such as batteries and solar cells, eliminating the need for an AC power line. The modular design of the furnace allows for the addition of heat exchangers and other assemblies to be incorporated into the furnace system.

The furnace can be scaled for use in residential, commercial and industrial applications. In certain embodiments, the furnace can be scaled and ruggedized as a transportable unit suited for use in military and humanitarian applications in remote or isolated locations. In such an embodiment, the furnace can be land transported or air dropped into remote locations and setup to burn any locally available bio-fuel.

It is to be understood that both the foregoing description presents exemplary embodiments of the invention and are intended to provide an overview or framework for understanding the nature and character of the invention as it is claimed. The description serves to explain the principles and operations of the claimed subject matter. Other and further features and advantages of the invention will be readily apparent to those skilled in the art upon a reading of the following disclosure. The embodiments of the present invention herein described and illustrated are not intended to be exhaustive or to limit the invention to the precise form disclosed. They are presented to explain the invention so that others skilled in the art might utilize its teachings. The embodiment of the present invention may be modified within the scope of the following claims.

I claim:

1. A furnace for burning bio-fuel comprising:

a combustion unit;

a bio-fuel feed assembly operatively connected for selectively depositing bio-fuel into the combustion unit for combustion;

an airflow management apparatus operatively connected to the combustion unit for regulating airflow through the combustion unit; and control apparatus operatively connected to the combustion unit, the bio-fuel feed assembly and the airflow management assembly to control the combustion of bio-fuel within the combustion unit, the combustion unit includes a core having a core interior thereof within which bio-fuel is burned, the core also having an angle inlet port extending into the core interior and an exhaust port extending from the core interior, the airflow management apparatus includes a) a length of conduit helically wrapped around the core, b) a first fan connected in airflow communication to the length of conduit and the inlet port of the core for forcing ambient inlet air through the length of conduit and directionally into the core interior to create a combustion vortex of ambient inlet air, combusting bio-fuel to produce exhaust gases and thermal energy within the core interior when the bio fuel is burnt, and c) a second fan connected in airflow communication to the exhaust port of the core for creating a negative air pressure within the core interior to draw the combustion vortex through the core interior and exhaust air from the core, the length of conduit constitutes a preheat coil adapted to transfer thermal energy from the core into ambient inlet air circulated therethrough to superheat the inlet air to a temperature above the combustion temperature of the bio-fuel.

2. The bio-fuel furnace of claim 1 wherein the control apparatus includes a controller electrically wired to the inlet fan and the exhaust fan for selectively regulating the flow of ambient inlet air into the core interior and flow of exhaust air from the core interior so that the flow of exhaust air from the core interior is greater than the flow of ambient inlet air into the core interior.

3. The bio-fuel furnace of claim 1 wherein the control apparatus includes a vacuum sensor mounted to the combustion unit for measuring the air pressure within the core interior.

4. The bio-fuel furnace of claim 1 wherein the combustion unit includes a feed chute connected to the core and the bio-fuel feed assembly.

5. The bio-fuel furnace of claim 1 wherein the core includes a plurality of vertically stacked core sections.

6. The bio-fuel furnace of claim 5 wherein the core is constructed of a ceramic material that stores thermal energy.

7. The bio-fuel furnace of claim 1 wherein the core interior is divided into a combustion chamber and an expansion chamber spaced above the combustion chamber in open airflow communication through a passage therebetween.

8. The bio-fuel furnace of claim 1 wherein the airflow management apparatus further includes a compressor connecting the core in airflow communication with the core interior for providing selective blasts of compressed air flow into the core interior.

9. The bio-fuel furnace of claim 8 wherein the airflow management apparatus further includes a nozzle seated within the core for directing the blast of compressed air into the core interior.

10. The bio-fuel furnace of claim 1 wherein the length of conduit is constructed of a thermal conducting material.

11. The bio-fuel furnace of claim 1 and a particle separator connected in open airflow communication to the combustion unit.

12. The bio-fuel furnace of claim 11 wherein the particle separator is connected between the exhaust port and the second exhaust fan.

13. The bio-fuel furnace of claim 12 wherein the particle separator has a separator interior therein, the second fan creating a negative air pressure within the separator interior to draw the combustion vortex through the core interior and into the separator interior.

14. The bio-fuel furnace of claim 1 and a heat exchanger seated atop the combustion unit.

* * * * *